US010563453B2

(12) United States Patent
Steinke

(10) Patent No.: US 10,563,453 B2
(45) Date of Patent: Feb. 18, 2020

(54) WEATHERSTRIPPING ASSEMBLIES FOR GARAGE DOORS AND OTHER APPLICATIONS, ASSOCIATED APPARATUSES, AND ASSOCIATED METHODS OF USE

(71) Applicant: Bradley Steinke, Grande Prairie (CA)

(72) Inventor: Bradley Steinke, Grande Prairie (CA)

( * ) Notice: Subject to any disclaimer, the term of this patent is extended or adjusted under 35 U.S.C. 154(b) by 9 days.

(21) Appl. No.: 15/709,173

(22) Filed: Sep. 19, 2017

(65) Prior Publication Data

US 2018/0080277 A1 Mar. 22, 2018

Related U.S. Application Data

(60) Provisional application No. 62/396,674, filed on Sep. 19, 2016.

(51) Int. Cl.
*E06B 7/23* (2006.01)

(52) U.S. Cl.
CPC ..... *E06B 7/2312* (2013.01)

(58) Field of Classification Search
CPC ..... E06B 7/2312; E06B 7/2314
USPC ..... 49/475.1, 484.1, 492.1, 495.1, 496.1
See application file for complete search history.

(56) References Cited

U.S. PATENT DOCUMENTS 2,345,273 A * 3/1944 Macklanburg ..... E06B 7/231 49/444
3,131,441 A * 5/1964 Cornell ..... E06B 7/20 49/314
3,238,573 A * 3/1966 Pease, Jr. ..... E06B 7/2309 49/383
3,535,824 A 10/1970 Kessler
3,690,037 A * 9/1972 Kempel ..... E06B 1/70 16/242
4,170,846 A * 10/1979 Dumenil ..... E06B 7/20 49/303
4,447,989 A * 5/1984 Mailand ..... E06B 7/2316 49/482.1
4,527,368 A * 7/1985 Jentoft ..... E04D 13/1475 52/200
4,742,646 A * 5/1988 Kehrli ..... E06B 7/2312 49/479.1
4,807,397 A * 2/1989 Doan ..... E06B 7/2309 49/383
4,947,585 A * 8/1990 Guetle, Jr. ..... E06B 3/88 49/462
5,117,587 A * 6/1992 Doan ..... E06B 7/2309 49/383
5,174,065 A * 12/1992 Schlicht ..... E06B 7/2312 49/470
5,408,784 A * 4/1995 Wruck ..... E06B 3/308 49/489.1

(Continued)

FOREIGN PATENT DOCUMENTS

GB 2065209 A * 6/1981 ..... E06B 7/231
GB 2143567 A * 2/1985 ..... E06B 7/22

*Primary Examiner* — Brian D Mattei
(74) *Attorney, Agent, or Firm* — Robert A. Nissen

(57) ABSTRACT

An apparatus includes: an elongate weatherstrip, which forms in cross-section: a blade; a retainer connector adjacent a first face and partway between opposed ends of the blade; and one or more sealing members along a second face of the blade. A method includes installing a weatherstripping assembly on a door, window, door frame, or window frame, of a building or vehicle.

20 Claims, 1 Drawing Sheet

(56) References Cited

U.S. PATENT DOCUMENTS

| | | | | |
|---|---|---|---|---|
| 5,622,008 | A | 4/1997 | King | |
| 8,726,575 | B1 * | 5/2014 | Vulpitta | E06B 7/22 49/470 |
| 8,881,464 | B1 | 11/2014 | Huckeba | |
| 2010/0058670 | A1 * | 3/2010 | Rissone | E06B 7/2312 49/495.1 |
| 2012/0304543 | A1 * | 12/2012 | Preising, Jr. | E06B 7/2314 49/495.1 |
| 2013/0031842 | A1 | 2/2013 | Murree et al. | |

* cited by examiner

WEATHERSTRIPPING ASSEMBLIES FOR GARAGE DOORS AND OTHER APPLICATIONS, ASSOCIATED APPARATUSES, AND ASSOCIATED METHODS OF USE

TECHNICAL FIELD

This document relates to weatherstripping assemblies and associated apparatuses and methods of use.

BACKGROUND

Conventional garage door weatherstripping consists of a metal strip retainer coupled to a bulb of a sweep-shaped vinyl weatherstrip.

SUMMARY

An apparatus comprising: an elongate weatherstrip, which forms in cross-section: a blade; a retainer connector adjacent a first face and partway between opposed ends of the blade; and one or more sealing members along a second face of the blade.

A method is disclosed comprising installing a weatherstripping assembly on a door, window, door frame, or window frame, of a building or vehicle.

An apparatus is disclosed comprising: an elongate weatherstrip retainer, which forms in cross-section: a weatherstrip connector; a base part that extends from the weatherstrip connector and defines a fastener insertion zone; and a sheet receptacle that extends from a front face of the base part and opens toward the fastener insertion zone.

An apparatus is disclosed comprising: an elongate weatherstrip, which forms in cross-section: a blade positioned within a gap between a garage door and a garage door frame; and a bulb that extends from the blade partway between opposed ends of the blade; and an elongate weatherstrip retainer, which forms in cross-section: a bulb connector connected to the bulb; a base part that extends from the bulb connector along the garage door frame; and a sheet receptacle that extends from a front face of the base part.

An apparatus comprising: an elongate weatherstrip, which forms in cross-section: a blade positioned within a gap between a) a window or a door and b) a window frame or a door frame, respectively; and a retainer connector that extends from the blade partway between opposed ends of the blade; and an elongate weatherstrip retainer, which forms in cross-section: a weatherstrip connector connected to the retainer connector; a base part that extends from the weatherstrip connector along the window frame or door frame, respectively; and a sheet receptacle that extends from a front face of the base part.

In various embodiments, there may be included any one or more of the following features: A mounting arm is extended from the first face of the blade partway between opposed ends of the blade. The blade forms a lead section and a tail section, with the mounting arm extended at a junction defined between the lead section and the tail section; and the one or more sealing members are positioned along the lead section and the tail section. The one or more sealing members comprise one or more of a plurality of fins and a hollow compressible part. The blade, the mounting arm, the retainer connector, and the one or more sealing members are integrally formed together of elastomeric material. The retainer connector forms a bulb that extends from: the mounting arm; the blade; or the mounting arm and the blade. The bulb extends from a junction defined between the mounting arm and the blade. The elongate weatherstrip forms a uniform shape in cross-section along a longitudinal axis defined between axial ends of the elongate weatherstrip. The second face of the blade forms a door contacting surface or a window contacting surface; and the mounting arm forms a door frame mount or a window frame mount, respectively. The blade is positioned within a gap between a) a door or a window, and b) a door frame or a window frame, respectively; and the mounting arm is mounted on the door frame or the window frame, respectively. The blade is positioned within a gap between a garage door and a garage door frame; and the mounting arm is mounted on the garage door frame. An elongate retainer, which forms in cross-section: a weatherstrip connector that connects to the retainer connector; a base part that extends from the weatherstrip connector, with a fastener securing the base part to the door frame or the window frame; and a sheet receptacle that extends from a front face of the base part and opens toward the fastener. A cladding sheet is positioned within the sheet receptacle and covers the fastener. The cladding sheet wraps around plural sides of the door frame or the window frame. An elongate retainer, which forms in cross-section: a weatherstrip connector that connects to the retainer connector; a base part that extends from the weatherstrip connector and defines a fastener insertion zone; and a sheet receptacle that extends from a front face of the base part and opens toward the fastener insertion zone. The weatherstrip connector, the base part, and the sheet receptacle are formed from a folded sheet. The folded sheet comprises, in sequence: a first sheet part that forms the weatherstrip connector; a second sheet part that is connected at a first bend to the first sheet part; a third sheet part that is connected at a second bend to the second sheet part, and that is folded back over the second sheet part to define the fastener insertion zone; and a fourth sheet part that is connected at a third bend to the third sheet part, and that is folded back over the third sheet part toward the second bend to define the sheet receptacle. The sheet receptacle is located between the weatherstrip connector and the fastener insertion zone. Installing the apparatus on a door, window, door frame, or window frame. Forming the retainer, for example by roll-forming.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figures 1, 1A, 1B, 2, 3, 4, 5, 6:
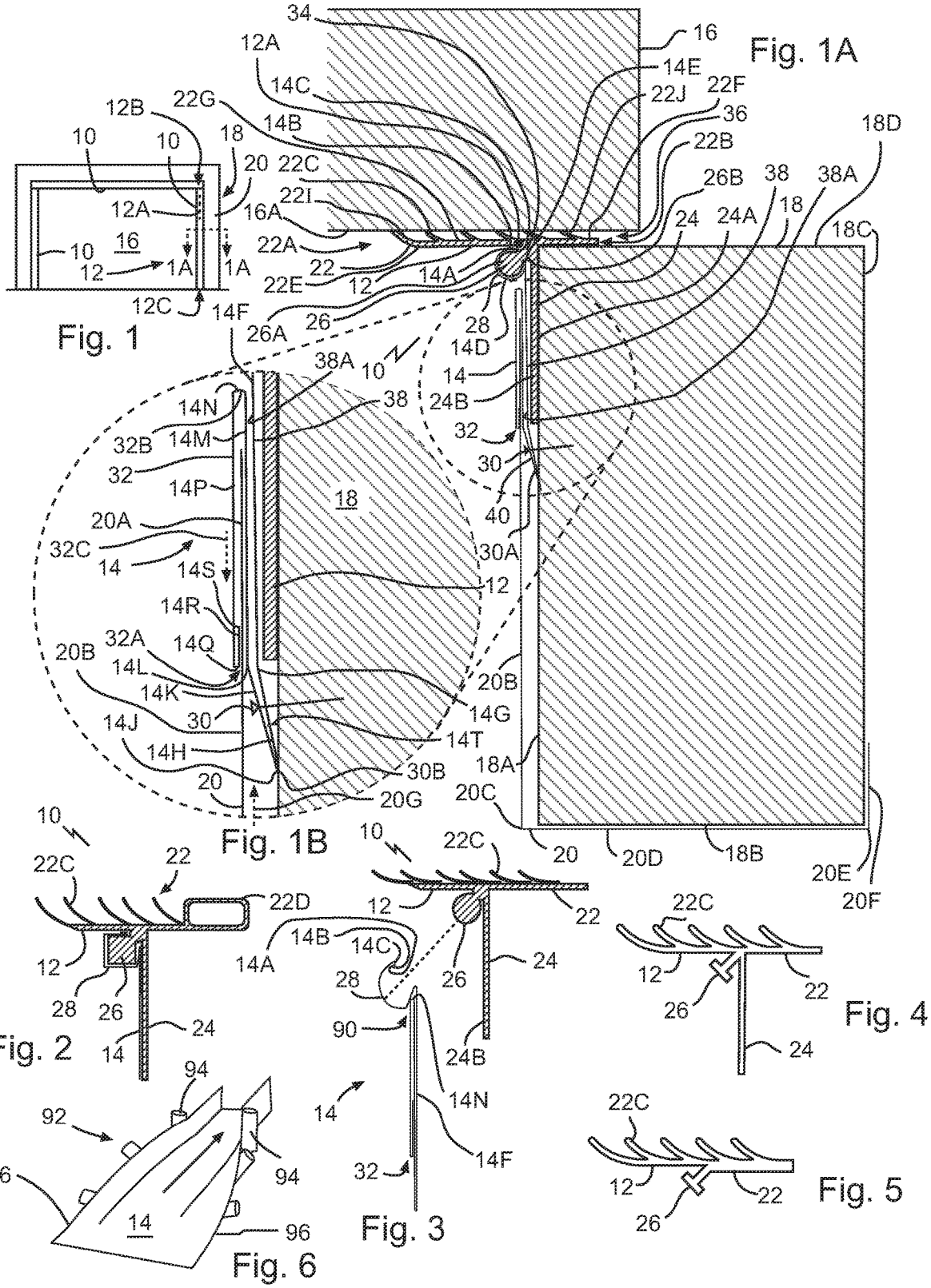
FIG. 1 is a front elevation view of a garage door with an embodiment of a weatherstrip assembly lining the top and side edges of the door and door frame.
FIG. 1A is a section view taken along the 1A-1A section lines from FIG. 1.
FIG. 1B is an exploded view of the area marked in dashed lines in FIG. 1A.
FIG. 2 is a section view of another embodiment of a weatherstrip assembly.
FIG. 3 is a section view of another embodiment of a weatherstrip assembly.
FIG. 4 is a top plan view of another embodiment of a weatherstrip assembly.
FIG. 5 is a top plan view of another embodiment of a weatherstrip assembly.
FIG. 6 is perspective view illustrating a method of roll-forming a part of weatherstrip retainer.

Immaterial modifications may be made to the embodiments described here without departing from what is covered by the claims.

Weatherstripping refers to the process of sealing gaps or openings between doors or windows and their respective frames. Weatherstripping also refers to parts that are used to achieve such a process, for example a strip of material that is structured to act as a cover over a gap or opening. Weatherstripping may serve as an insulative barrier to isolate adjacent environments, for example to isolate an interior of a building from external elements, such as moisture, cold, heat, hail, dirt, debris, wind, and even noise, present outside the building. Weatherstripping may improve the efficiency of interior heating and air conditioning processes, and may increase interior comfort.

A weatherstrip assembly for a door or a window may include a first strip of flexible or resilient material (a weatherstrip) connected to a second strip of material (a retainer), for example a rigid strip of material. The weatherstrip may form a sweep or hook, and may be positioned along one or more edges of the door or window. The weatherstrip may be made from a suitable material, such as felt, rubber, vinyl, foam, silicone, ethylene propylene diene monomer (M-class) rubber (EPDM), thermoplastic elastomer, mixes of plastic and rubber, thermoplastic olefin polymer/filler blends, polymeric material, or other suitable materials, including metal and magnetic materials in some cases. The retainer may be connected to the weatherstrip, for example using a J-hook or other suitable connection mechanism, and may provide a mechanism for fastening or attaching the weatherstrip to the frame, window, or door. The retainer may be made from suitable materials, including metals such as brass or aluminum, steel, or non-metals such as plastics or other polymers. In some cases the retainer may be replaced by a channel, such as a kerf, or other integral part formed within the door, window, or frame. The weatherstripping assembly may form a threshold that matches the shape of the door or window. The retainer base may be secured to the door by a suitable mechanism such as fasteners, including nails, screws, or other mechanisms such as adhesive. Weatherstripping may be used on automobiles to seal the interior, the trunk, the hood, or other covered parts of the automobile from the external environment. Weatherstripping material may be selected to be resistant to one or more of vibration, temperature flux, UV sunlight, moisture from rain, and chemicals such as oil, gasoline, and windshield washer fluid in the case of automotive weatherstripping.

One application of weatherstripping is to form a moisture and thermally insulative seal between a garage door and a respective frame. Garage door weatherstripping may be applied to the bottom of the door, for example using a U-shaped bottom weather seal mounted to an extruded metal retainer. The weather seal ensures the water-tightness of the threshold and remains flexible and watertight in the coldest weather. Garage door weatherstripping may be also applied to the top and sides of a garage door or door frame to seal out drafts, dust, dirt, and water from entering around the side and top edges of the garage door. Top and side edge weatherstripping may be made of vinyl. A garage door represents a challenge to adequately weatherstrip, as a garage door has large dimensions, relative to other building doors, for example to permit entry of two or more vehicles to be parked within a garage. Due to the large dimensions of the door, even small misalignments between the garage door and frame may compromise the effectiveness of the weatherstripping, leading to gaps that may permit moisture ingress into the garage and/or loss of heating of cooling efficiency.

Referring to FIGS. 1A, 2, and 3, an apparatus such as a weatherstrip assembly 10, is illustrated comprising an elongate weatherstrip 12, which forms in cross-section a blade 22 and a retainer connector, such as a bulb 26. The weatherstrip 12 may be formed of elastomeric material. Referring to FIG. 1A, the weatherstrip 12 may form in cross-section a mounting arm 24 extended from a first face, such as a front face 22E, of the blade 22 partway between opposed ends 22A and 22B of the blade 22, for example forming a T or Y-shape. A T-shaped weatherstrip may form a relatively higher sealing surface area, than a corresponding L-shape weatherstrip. Elongate elastomeric weatherstrip 12 may form in cross-section one or more sealing members 22C along a second face, such as a rear face 22F, of the blade 22, with the faces 22E and 22F opposed to one another in some cases. The bulb 26 may be adjacent the front face 22E and partway between opposed ends 22A and 22B of the blade 22. Blade 22, mounting arm 24, bulb 26, and sealing members 22C may be integrally formed together, for example from rubber or other suitable elastomeric material. Referring to FIGS. 1 and 1A, weatherstrip 12 may have a uniform shape in cross-section along a portion, for example an entirety as shown, of a longitudinal axis 12A defined between axial ends 12B and 12C of the elongate elastomeric weatherstrip 12.

Referring to FIG. 1A, sealing members 22C may be oriented in a fashion suitable for forming a seal, for example to seal a gap 36 between adjacent surfaces. Sealing members 22C may be positioned along either side of a junction 34 defined between mounting arm 24 and blade 22. Sealing members 22C may be extended from and positioned along both a first or lead section 22I of the rear face 22F of the blade 22, and a second or tail section 22J of the rear face 22F. The blade 22 may form lead section 22I and a tail section 22J, with the mounting arm 24 extended at junction 34 defined between the lead section 22I and the tail section 22J. Lead section 22I may be closer to a first end 22A of the blade 22, while second section 22J may be closer to a second end 22B of blade 22. During use sealing members 22C on tail section 22J may be inserted into gap 36 while sealing members 22C on lead section 22I may be positioned outside gap 36 but in contact with door 16, a window, or a frame. Such a configuration provides a seal both within gap 36 and outside gap 36. Sealing members 22C may act in concert to increase the sealing capacity of elongate elastomeric weatherstrip 12 relative to a conventional sweep weatherstrip, which in use forms an L-shape that lacks a tail section 22J.

Referring to FIG. 1A, sealing members 22C may be provided in a variety of configurations and numbers. A plurality of sealing members 22C may provide redundant seal protection, such that if one sealing member 22C fails, for example as a result of wear over time, one or more of the other sealing members 22C will continue to maintain the seal. Plural sealing members 22C may also increase the R-value (measure of thermal resistance) insulation rating across the seal by forming a series of air-filled insulative channels in use. Referring to FIG. 2, sealing members 22C may form one or more of fins (shown with reference numeral 22C), a hollow compressible part such as a bulb 22D, or another suitable sealing member. Hollow compressible bubble or bulb 22D may be located to fit within gap 36 to act as a plug, or may be located at other points along the blade 22. Hollow sealing members 22C may be air-filled or filled with solid components, for example foam. Fins or other members 22C may be oriented at an angle such as 45 degrees relative to blade 22. Sealing members 22C may form angles with blade 22 that are higher or lower than 45 degrees. The one or more sealing member may be integrally formed with the blade 22, for example if the sealing member is a compressible part of the blade 22. The blade 22 may form a dynamic seal between a door or window and a seating surface on the associated frame.

Referring to FIG. 1A, bulb 26 may be provided as an example of a part that connects to an elongate weatherstrip retainer 14, and may have a structure suitable for making such connection. Bulb 26 may extend from a front face 24B of the mounting arm 24, the front face 22E of the blade 22, or the front face 24B of the mounting arm 24 and the front face 22E of the blade 22. In the example shown, bulb 26 extends from junction 34 defined between mounting arm 24 and blade 22. Referring to FIGS. 1A, 2, 3, and 4, bulb 26 may have a suitable shape, such as a circular or oval shape as shown in FIGS. 1A and 3, a rectangular or square shape as shown in FIG. 2, a T-shape as shown in FIG. 4, a cross shape, a suitable polygonal shape, or another suitable shape defined by one or more of straight, curved, or angled edges, including a blade shape. Referring to FIG. 1A, bulb 26 may be hollow or solid, and if hollow may be filled with air or a solid material. Bulb 26 may have a head part 26A, for example a bulbous part, and a neck part 26B that is narrower in cross-section than head part 26A to facilitate retention of bulb 26 by retainer 14. Other forms of retainer connectors may be used in place of a bulb 26, for example a channel (not shown) may be used into which a part of the retainer 14 may insert to retain the weatherstrip 12. A fastener or other mechanism (not shown) such as adhesive may secure the retainer 14 and weatherstrip 12 together.

Referring to FIG. 1A, weatherstrip assembly 10 may comprise an elongate weatherstrip retainer 14, which forms in cross-section a weatherstrip connector 28, for example a receptacle for receiving bulb 26, and a base part 38 extending from weatherstrip connector 28. Base part 38 may define a fastener insertion zone 30A for a fastener 30, for example a screw or nail. Referring to FIG. 1B, elongate weatherstrip retainer 14 may form in cross-section a sheet receptacle 32. Receptacle 32 may extend from a front face 38A of the base part 38, for example opening in a direction 32C toward fastener 30 and/or zone 30A. Referring to FIG. 1A, weatherstrip bulb connector 28 may have a circular, hexagonal, octagonal, or other shape suitable for connecting to, mounting, retaining, or gripping bulb 26.

Referring to FIG. 1B, sheet receptacle 32 may be structured to permit a part, for example a sheet 20, to be inserted into sheet receptacle 32 to cover fastener 30. The ability to cover the fastener 30 may reduce or eliminate the appearance of any unsightly oil canning caused by distortion of the zone 30A on insertion of the fastener 30. Oil canning refers to buckling or deformation of a material, for example a flat sheet metal panel, caused by uneven stresses at fastening points. Sheet receptacle 32 may be located between weatherstrip bulb connector 28 and fastener insertion zone 30A. Sheet receptacle 32 may define an insertion mouth 32A and an end wall 32B, both insertion mouth 32A and end wall 32B being located between weatherstrip bulb connector 28 and fastener insertion zone 30A. Sheet receptacle 32 may receive a sheet 20 that has a length sufficient to extend between end wall 32B and cover fastener insertion zone 30A, extending in some cases to a terminal end 30B of zone 30A.

Referring to FIG. 1A, retainer 14, or part of it, may be formed from a folded sheet 40. Bulb connector 28, base part 38, and sheet receptacle 32 of retainer 14 may be formed from folded sheet 40, for example made of 22 to 30 gauge aluminum or steel, for example 25-28 gauge aluminum or steel, or other suitable materials and gauges of sheets. In some cases the retainer 14 is formed with plural sheets layered together, for example bonded or fused together.

Referring to FIG. 1A, the sheet 40 may be bent in a suitable fashion to achieve the functionality described in this document. Folded sheet 40 may have a first span or sheet part 14D that is shaped, for example bent, to form, connector 28. Sheet part 14D may be circular as shown to retain a corresponding circular bulb 26. Referring to FIG. 6, bends in this document may be formed by a suitable method, for example using a power bending tool such as a device that shapes the retainer 14 using a plurality of rollers, such as a roll-forming machine 92. Roll forming is a type of rolling involving the continuous bending of a long strip of sheet metal (typically coiled steel) into a desired cross-section. The strip passes, for example in a longitudinal/axial direction, through sets of rolls 94 mounted on consecutive stands, for example located on either longitudinal side edge 96 of the strip, each set performing only an incremental part of the bend, until the desired cross-section (profile) is obtained. Roll forming may be used for producing constant-profile parts with long lengths and in large quantities. Sheet part 14D may be connected to a sheet part 14B, for example at a bend 14C, with sheet part 14B folded over sheep part 14D to form a reinforcing lip to strengthen the connector 28 and in some cases define a terminal tip end 14A of the sheet 40. The sheet part 14B may be bent towards an exterior surface of the bulb connector 28 such that a tip end 14A is positioned outside bulb connector 28. Referring to FIG. 3, in another example sheet part 14B may be bent towards an interior surface of the bulb connector 28 such that tip end 14A is positioned inside bulb connector 28 after assembly.

Referring to FIGS. 1A-B, a second sheet part, for example collectively formed by respective sheet parts 14F and 14H as shown, may be connected at a bend 14E to sheet part 14D. Referring to FIG. 1B, a third sheet part, for example collectively formed by respective sheet part 14M and 14K, may be connected at a second bend 14J to sheet part 14H. In some cases, second bend 14J, and/or part 14H contacts a frame 18, a door or window. The third sheet part may be folded back over the second sheet part to define to define fastener insertion zone 30A, for example located by part 14K overlying part 14H. Part 14H may be positioned at an angle 14T relative to frame 18. When inserted fastener 30 may compress elongate elastomeric weatherstrip 12 against the frame 18. In the example shown, parts 14F, 14H, 14K and 14M collectively form base part 38. Parts 14F and 14H may be connected via a bend 14G, while parts 14K and 14M may be connected via a bend 14L. In some cases no bends 14G or 14L may be provided.

Referring to FIG. 1A, as above, retainer 14 may have a sheet receptacle 32 for receiving a cladding sheet 20. The sheet receptacle 32 may be formed as follows. A fourth sheet part 14P may be connected at a third bend 14N to the third sheet part. Fourth sheet part 14P may be folded back over the third sheet part, for example toward the second bend 14J to define sheet receptacle 32. Referring to FIG. 3, the bend 14N may abut or sit adjacent the connector 28 to reduce the chance of ingress of elements, insects, plant material, fungus, and other unwanted items. In the example shown, the bend 14N is located within a pocket 90 defined between the sheet 14F and the connector 28. Referring to FIG. 1A, a fifth sheet part 14R may be connected at a bend 14Q to sheet part 14P, and may be folded back over the fourth sheet part and inward or outward to form a reinforcing lip and in some cases to define a terminal tip end 14S of the sheet 40.

Referring to FIG. 1, weatherstrip 12 may be mounted in use to a door frame, for example a garage door frame 18 as shown, or a window frame, a door, for example a garage door 16, or a window. Referring to FIG. 1A, blade 22, for example rear face 22F, may form a door contacting surface (shown) or a window contacting surface, while the mounting arm 24, for example rear face 24A, may form a door frame mount (shown) or a window frame mount, respectively. Base part 38 may extend from bulb connector 28 along garage door frame 18, for example along an inside wall 18A of the frame 18, the inside wall 18A being adjacent to a rear wall 18A that forms a seating surface for a front wall 16A of the garage door 16 to contact or come into close proximity with in use when the door is in a closed position. Blade 22 may be positioned within gap 36 between a) a door 16 or a window, and b) a door frame 18 or a window frame, respectively. Lead section 221 of the blade 22 may have sealing members 22C positioned outside gap 36 against wall 16A and tail section 22J of the blade 22 may have sealing members 22C positioned inside gap 36. The use of assembly 10 may increase the R-value of garage door 16 relative to a standard sweep type weatherstrip for a garage door.

Referring to FIG. 1A, during use cladding sheet 20 may be positioned within sheet receptacle 32 to cover fastener 30, and in some cases all or part of garage door frame 18. Cladding sheet 20 may wrap around plural sides of the frame 18, for example to act as protective and decorative siding for the frame 18, and to cover any oil canning that may have occurred on base part 38 as a result of fastener 30 insertion. Cladding sheet 20 may be formed by a folded sheet. A first sheet part 20B of flashing or cladding sheet 20 may be positioned within receptacle 32 to cover fastener 30 and inner frame side wall 18A. A second sheet part 20D, may be connected to sheet part 20B by bend 20C. Sheet part 20D may cover front frame side wall 18B during use. A third sheet part 20F may be connected to second sheet part 20D via bend 20E. Third sheet part 20D may cover outer frame side wall 18C, for example partially (shown) or wholly. As shown the sheet part 20F may terminate partway along a side wall 18C, and may form a terminal tip, which may be folded back on itself to form a reinforcing lip. Cladding sheet 20 may cover fastener insertion zone 30A, cover a portion of frame 18, or may fit entirely over and around frame 18. Cladding sheet 20 may be made of a suitable material, such as metal such as aluminum or steel, wood, polymer, or other product that slides into sill trim. A sheet 20 may be purchased in a folded state, or may be brought to site, cut to length, and bent on site prior to installation.

Assembly 10 may be made by suitable methods. Retainer 14 may be formed via a suitable system, for example by hand, using hand tools, or by using a mechanized system of rollers, for example chrome-faced rollers. A suitable mechanized system may have various 16 stages of rollers, each of which progressively bend a strip of starting material to form retainer 14. In a mechanized system a chain and gear drive may turn all rollers at the same time to reduce or eliminate scratches on final product. Weatherstrip 12, retainer 14, or assembly 10 may be formed and supplied as a complete product and may be sold in coiled form, for example containing 5000 feet of 7¾-8" wide weatherstripping, although other suitable sizes and widths may be used. Weatherstrip 12 may be formed by passing an elastomeric material through an extrusion machine. On site, or at another suitable location, the assembly 10, retainer 14, or weatherstrip 12 may be cut to a desired length to fit a particular application. Weatherstrip assembly 10 may be produced using a chain and gear driven machine in which all rollers turn at the same time to reduce or eliminate scratches on final product. Cladding sheet 20, and/or retainer 14 may be made via extrusion or other suitable methods Junction 34 may be defined by a plurality or range of connection points. Mounting arm 24 may be positioned within 0-40% deviation from a center point between opposed blade ends 22A and 22B. Rear face 22F of blade 22 may rest flush against frame 18 during use. Rear face 24A of the mounting arm 24 may rest flush against frame 18 during use.

Bolts, nails, or other suitable fasteners, or welding, adhesive, and other adhering methods may be used to mount weatherstrip assembly 10 to frame 18. Base part 38 and mounting arm 24 may each form a panel. Retainer 14 may be made of a wear-resistant material. Retainer 14 may generally form a Z-shape. Retainer 14 may form a power bent moulding sill trim. Cladding sheet 20 may be bought and bent on sight.

Weatherstrip assembly 10 may be used when a moving part abuts a seating surface on a frame and no two faces of the moving part and the frame part are flush. Any one or more of the T-shapes described above in this disclosure may have legs or blades that are angled relative to one another. In this disclosure, elastomeric may include resilient or flexible material. The efficacy of weatherstripping can be significantly increased by specialty coatings during manufacture. After bonding to the weatherstrip, a coating may improve chemical and ultraviolet resistance, decrease the static coefficient of friction (thereby reducing the force required to open or close doors), and reduce or eliminate noise. The assembly 10 may be used on a man door in a garage. Weatherstrip 12 may be made of metal in some cases.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An apparatus comprising:

an elongate weatherstrip, which forms in cross-section:

a blade;

a retainer connector adjacent a first face and partway between opposed ends of the blade; and one or more sealing members along a second face of the blade, the blade forming a lead section and a tail section, and the second face of the blade forming a door contacting surface or a window contacting surface to permit the tail section of the blade to in use be positioned within a gap between a) a door or a window, and b) a door frame or a window frame, respectively; and an elongate retainer, which forms in cross-section:

a weatherstrip connector that connects to the retainer connector;

a base part that extends from the weatherstrip connector and defines a fastener insertion zone to permit the apparatus to be attached by a fastener in use to the door frame or the window frame, respectively; and a sheet receptacle that extends from a front face of the base part and opens toward the fastener insertion zone.

2. The apparatus of claim 1 further comprising a mounting arm extended from the first face of the blade partway between opposed ends of the blade.

3. The apparatus of claim 2 in which:

the mounting arm is extended at a junction defined between the lead section and the tail section; and the one or more sealing members are positioned along the lead section and the tail section.

4. The apparatus of claim 2 in which the blade, the mounting arm, the retainer connector, and the one or more sealing members are integrally formed together of elastomeric material.

5. The apparatus of claim 2 in which the retainer connector forms a bulb that extends from:

the mounting arm;

the blade; or the mounting arm and the blade.

6. The apparatus of claim 5 in which the bulb extends from a junction defined between the mounting arm and the blade.

7. The apparatus of claim 2 in which:

the mounting arm forms a door frame mount or a window frame mount, respectively.

8. The apparatus of claim 1 in which:

the tail portion of the blade is positioned within a gap between a) a door or a window, and b) a door frame or a window frame, respectively; and the base part is mounted on the door frame or the window frame, respectively.

9. The apparatus of claim 8 in which:

a fastener secures the base part to the door frame or the window frame; and the sheet receptacle extends from a front face of the base part and opens toward the fastener.

10. The apparatus of claim 9 in which a cladding sheet is positioned within the sheet receptacle and covers the fastener.

11. The apparatus of claim 10 in which the cladding sheet wraps around plural sides of the door frame or the window frame.

12. The apparatus of claim 1 in which:

the tail portion of the blade is positioned within a gap between a garage door and a garage door frame; and the base part is mounted on the garage door frame.

13. The apparatus of claim 1 in which the elongate weatherstrip forms a uniform shape in cross-section along a longitudinal axis defined between axial ends of the elongate weatherstrip.

14. The apparatus of claim 1 in which the one or more sealing members comprise one or more of a plurality of fins and a hollow compressible part.

15. The apparatus of claim 1 in which the weatherstrip connector, the base part, and the sheet receptacle are formed from a folded sheet.

16. The apparatus of claim 15 in which the folded sheet comprises, in sequence:

a first sheet part that forms the weatherstrip connector;

a second sheet part that is connected at a first bend to the first sheet part;

a third sheet part that is connected at a second bend to the second sheet part, and that is folded back over the second sheet part to define the fastener insertion zone; and a fourth sheet part that is connected at a third bend to the third sheet part, and that is folded back over the third sheet part toward the second bend to define the sheet receptacle.

17. The apparatus of claim 1 in which the sheet receptacle is located between the weatherstrip connector and the fastener insertion zone.

18. A method comprising installing the apparatus of claim 1 on a door, window, door frame, or window frame.

19. An apparatus comprising:

an elongate weatherstrip, which forms in cross-section:

a blade, having a lead section and a tail section, with the tail section positioned within a gap between a) a window or a door and b) a window frame or a door frame, respectively, and the lead section positioned outside the gap and along the window or door, respectively; and a retainer connector that extends from the blade partway between opposed ends of the blade; and an elongate weatherstrip retainer, which forms in cross-section:

a weatherstrip connector connected to the retainer connector;

a base part that extends from the weatherstrip connector along the window frame or the door frame, respectively; and a sheet receptacle that extends from a front face of the base part.

20. An apparatus comprising:

an elongate weatherstrip, which forms in cross-section:

a blade;

a retainer connector adjacent a first face and partway between opposed ends of the blade; and one or more sealing members along a second face of the blade; and an elongate retainer, which forms in cross-section:

a weatherstrip connector that connects to the retainer connector;

a base part that extends from the weatherstrip connector and defines a fastener insertion zone; and a sheet receptacle that extends from a front face of the base part and opens toward the fastener insertion zone;

in which the weatherstrip connector, the base part, and the sheet receptacle are formed from a folded sheet, and the folded sheet comprises, in sequence:

a first sheet part that forms the weatherstrip connector;

a second sheet part that is connected at a first bend to the first sheet part;

a third sheet part that is connected at a second bend to the second sheet part, and that is folded back over the second sheet part to define the fastener insertion zone; and a fourth sheet part that is connected at a third bend to the third sheet part, and that is folded back over the third sheet part toward the second bend to define the sheet receptacle.

* * * * *